US008678615B1

(12) United States Patent
Ko

(10) Patent No.: US 8,678,615 B1
(45) Date of Patent: Mar. 25, 2014

(54) LIGHT STRAND CHRISTMAS TREE FOR FLAGPOLE

(76) Inventor: Gordon Ko, Phillips Ranch, CA (US)

( * ) Notice: Subject to any disclaimer, the term of this patent is extended or adjusted under 35 U.S.C. 154(b) by 229 days.

(21) Appl. No.: 13/307,619

(22) Filed: Nov. 30, 2011

(51) Int. Cl.
*F21V 33/00* (2006.01)

(52) U.S. Cl.
USPC . 362/234; 362/123; 362/249.18; 362/249.19; 362/403; 362/431

(58) Field of Classification Search
USPC ..... 211/196; 362/123, 234, 249.18, 249.19, 362/253, 403, 431, 568, 806; 428/18–20
See application file for complete search history.

(56) References Cited

U.S. PATENT DOCUMENTS

| | | | | |
|---|---|---|---|---|
| 3,704,366 | A | 11/1972 | Korb et al. | |
| 4,620,270 | A | 10/1986 | Laakso | |
| 5,094,893 | A | 3/1992 | Snider | |
| 6,334,694 | B1 | 1/2002 | Huang | |
| 6,652,927 | B1 * | 11/2003 | Chen | 362/123 |
| 7,152,998 | B2 | 12/2006 | Rahman | |
| 7,563,000 | B2 | 7/2009 | Gierveld | |

* cited by examiner

*Primary Examiner* — Stephen F Husar

(57) ABSTRACT

The present invention is a string light type Christmas tree kit for raising upon and being supported from a flagpole with rope and pulley for raising and lowering a flag. The kit includes a crown connector for connection of ends of multiple string lights and raising to at topmost position by the rope and pulley. A circular hoop structure is connected to lower ends of the string lights and is raised off the ground when the crown connector is raised to the topmost position, forming a conical, lighted structure providing the visual illusion of a lighted Christmas tree supported from a flagpole.

13 Claims, 16 Drawing Sheets

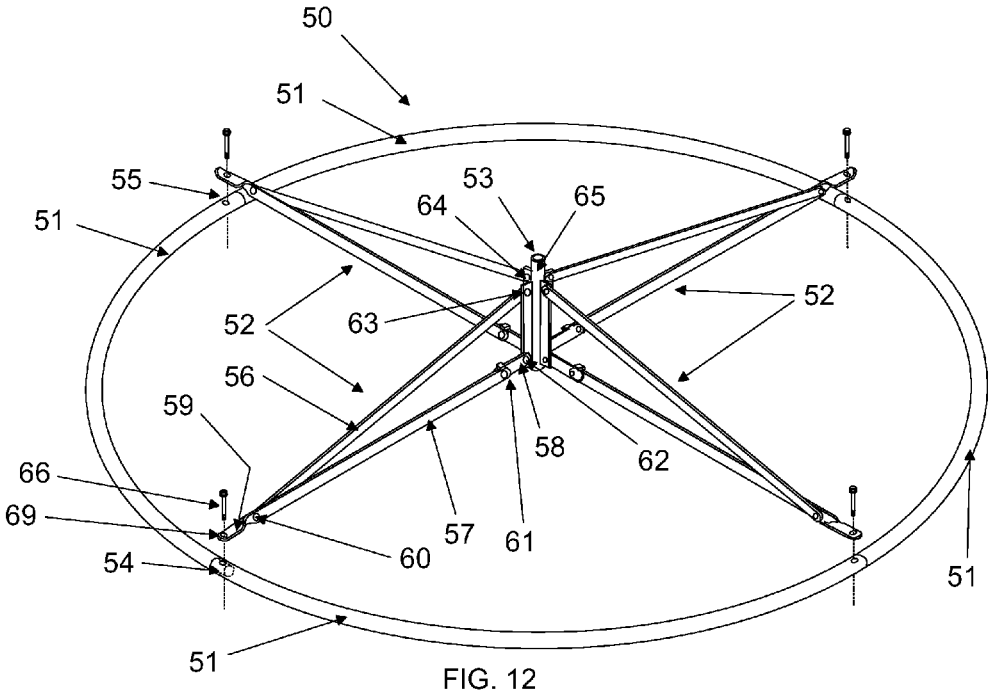
FIG. 12
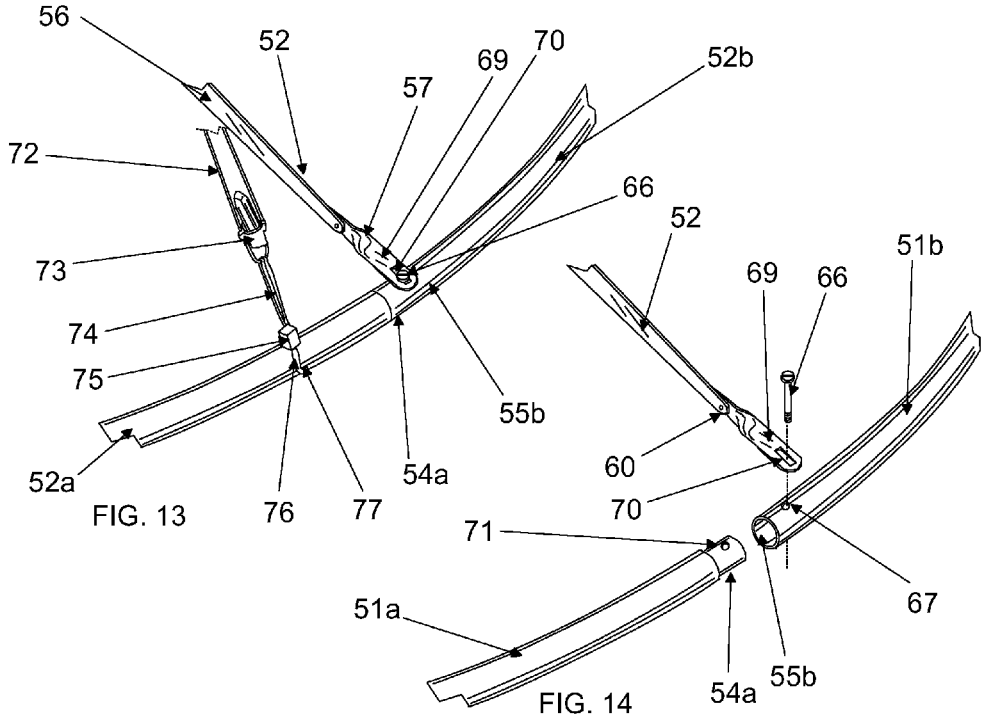
FIG. 13
FIG. 14

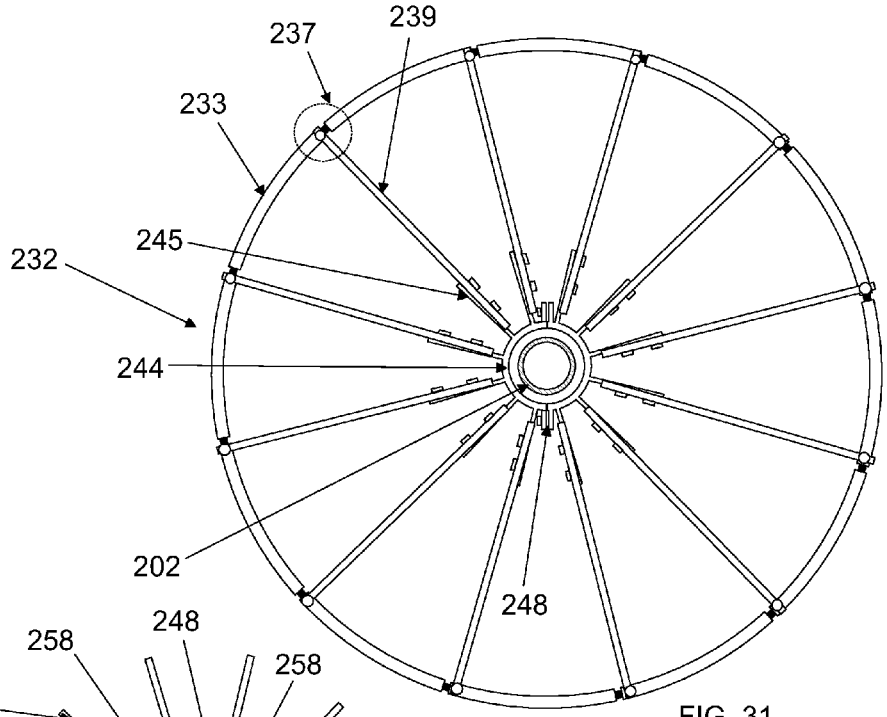
FIG. 31
FIG. 32
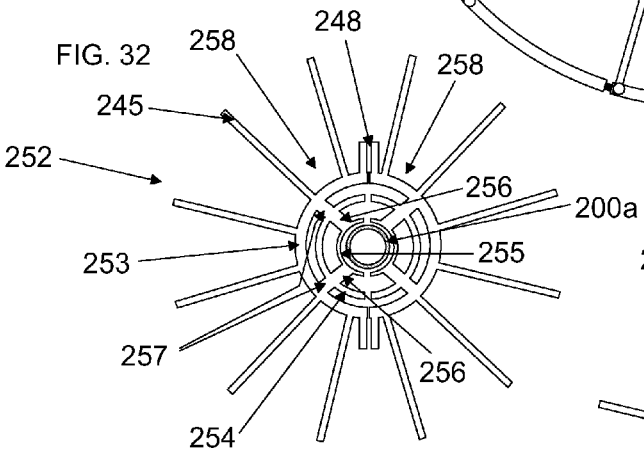
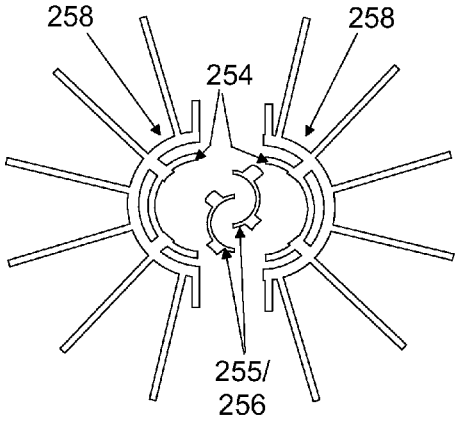
FIG. 33
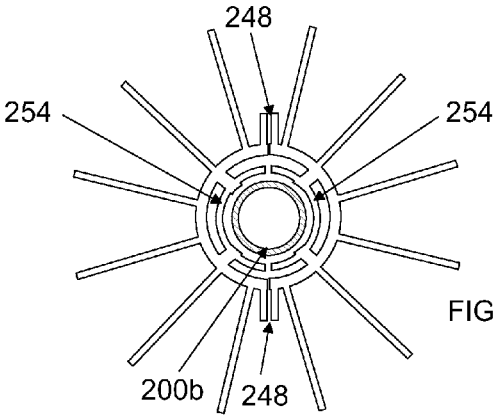
FIG. 34

LIGHT STRAND CHRISTMAS TREE FOR FLAGPOLE

FIELD OF THE INVENTION

The present invention relates to Christmas holiday decorations where strands of lights are secured at an upper location at a flagpole top and said strands extend to a circular base forming an illusion of a Christmas tree when the lights are powered.

BACKGROUND OF THE INVENTION

The art of imitation or artificial Christmas trees includes simulated tree shapes by supporting vertically a conical structure which appears to a viewer's eyes to incorporate elements of decorated Christmas trees.

In a very well known example, a generally round base is placed on a floor surface and a pole support extends up from the round base. A top end of the pole support connects to a round string light distribution crown piece. From the round crown piece radiate downward strings of Christmas lights which attach in some manner to a periphery of the round base. The crown piece incorporates means for electrically connecting the strings of Christmas lights so that main connector wires extend in some manner to the floor level so that a standard electrical plug can be plugged into a wall socket, thereby lighting the Christmas lights on the strings of lights. The overall visual effect of the assembly is a brightly lighted conical shape appearing to be a Christmas tree.

The advantages of such an imitation Christmas tree are clear. The weight of structural support members is dramatically reduced by providing guy wire-like support for a central, vertical pole by way of the radiating strings of lights, which are preferably connected to the round base with substantial tension in the string. The string light type Christmas tree has only three main elements with substantial weight, i.e., the strings of lights, the round base and the vertical support pole. This type of Christmas tree is surprisingly light and can be moved to many locations with minimal strength or difficulty.

Several references in the prior art address the problem of how to reduce stored volume of the string light type Christmas tree. U.S. Pat. No. 6,334,694, which is incorporated herein, discloses a round base capable formed from three rigid arc bands that define the circumference of the round base and a set of three elevated radial connectors that pivotally collapse from their support position to a folded down position for compact storage. A central axis pipe located at the rotating axis of the three radial connectors provides means for supporting the vertical pole support for the crown piece from which strings of lights radiate downward for connection to the arc bands constituting the circumference of the round base. It is essential for the successful operation of the '694 patent's round base that the arc bands be elevated sufficiently above floor level so that the vertical support pole is adequately supported by way of the central axis pipe. Unfortunately, imposing the elevation requirement on the round base of the '694 patent necessarily increases the minimum volume required for storage or initial product shipment when the entire structure is in a collapsed state. In addition, each arc band, when disassembled, defines a rather large rectangular, horizontal storage volume. Forming the arc bands of round bar stock necessarily increases the diameter of said bar stock required for overall structural integrity of the imitation tree, thereby tending to maximize vertical storage volume of the arc bands. It is estimated that minimum storage volume for a kit including all the elements of the disassembled components of the '694 patent make such a kit rather undesirable.

Several other prior art references disclose attempts at minimizing storage volume of disassembled string light type Christmas trees, such as in U.S. Pat. Nos. 7,563,000, 5,094,893, 7,152,998, 4,620,270, 5,094,893 and 3,704,366.

There is a need for a string light type Christmas tree having a more compact storage volume.

SUMMARY OF THE INVENTION

The present invention is a string light type Christmas tree comprising a vertical pole comprising multiple sections, a crown piece from which radiate strings of Christmas lights that is adapted to be secured to a top end of the vertical pole, and a round base from which the vertical pole is supported. The round base comprises four arc sections that comprise only a portion of a circumference of the round base. Each of the four arc sections are joined at their ends to T-shaped ends of an X-shaped arc support. The arc support comprises four flat panel sections radiating from a central pivot axis, whereby, when the flat panel sections are disconnected from the arc sections, the flat panel sections may be easily rotated into alignment with each other so that their rectangular, horizontal and vertical storage volume is only somewhat more than that required for a single such flat panel section. In addition, as the arc sections are also preferably formed of flat sheets of metal, the four disconnected arc sections can be stacked in alignment with each other so that their rectangular, horizontal and vertical storage volume is only somewhat more than that required for a single such arc section.

Dividing up circumferential elements of a round base in the above manner dramatically reduces the rectangular, horizontal and vertical storage volume required for storage of all the elements of the round base. In fact, the rectangular, horizontal and vertical storage volume of the aligned and disassembled arc sections is about the same as the same volume of the aligned and disassembled flat panel sections. The combination of said volumes is dramatically reduced for storage volume of the invention round base as compared with those of the prior art.

In the invention imitation Christmas tree, a bottom support pipe is secured to the central axis of the X-shaped arc support by way of a bolt extending from underneath the arc support through a hole at said axis and up through a hole in a bottom plate of the bottom support pipe. The tensioning effect of the light strings to be connected later makes such a bottom support for the vertical support adequate for extremely sturdy construction of the overall tree structure. Sections of pipe are joined to form a vertical support pole, an lower end of which is inserted into the bottom support pipe. The crown piece is fixed to a top end of the vertical support pole and its integrally attached strings of lights are hooked at distal ends to the arc sections at the round base. Connection of these ends is preferably by hooks fixed at such distal ends so insertion of the hook end through holes in the arc sections. Electrical connection means, such as joining the appropriate wire ends of the string lights at the crown piece, electrically connect the string lights to each other and to a central electrical connector. The central electrical connector is preferably a well known two conductor, insulated wire with a plug at a distal end for connection to household electrical power receptacle.

It is known to provide the vertical support pole in sections appropriate lengths for storage with controlling horizontal lengths of portions of the round base. In the present invention, such horizontal lengths (i.e., the horizontal length of a piece when on a flat tabletop along its longest end to end measure)

are reduced to a previously unknown degree when considered in combination with vertical space required for all of the disassembled elements of the invention tree.

The present invention further comprises a flagpole support for a string light type Christmas tree, where such a flagpole is impractically tall for direct installation of a crown connector at an upper end of the "tree". In this form of the invention, the crown connector is raised to a topmost position on the flagpole by way of the rope and pulley available for raising and lowering a flag on the flagpole. In a preferred structure and process, multiple strings of Christmas lights extend from upper connections at the crown connector to lower connections at arc segments of a circular hoop. When the crown connector is raised to a topmost position, said strings of lights are necessarily raised with it, leaving said arc sections dangling from the lower connections. In this position, the strings of lights form a rather dense drape close to most of the length of the flagpole. A user proceeds to assemble said arc lengths into said circular hoop, forcing the lower connections of the strings of lights from a generally vertical direction into approximately the same acute angle with reference to the vertical flagpole. Adjacent strings of lights are arranged generally equidistant as to their upper connections on the crown connector and as to their lower connections on the circular hoop, thereby resulting, when the hoop is assembled, in a conic structure approximating a Christmas tree shape defined by the lights on the strings of lights when the surroundings are sufficiently dark enough to see them when lighted. The strings of lights are essentially equal in length and are provided with elastic means for causing them to be maintained in a substantially straight line in the installed position.

BRIEF DESCRIPTION OF THE DRAWINGS

FIG. 12 is a top perspective view of an alternate embodiment of the invention round base for a light strand Christmas tree, having a vertically folding center portion shown in an exploded view away from a circular outside ring.

FIG. 13 is a broken away section of the round base of FIG. 12 where an end of one of the arms of the center portion is shown fixed to the outside ring.

FIG. 14 shows the components of FIG. 13 in an exploded view showing receiving and insertion ends of arc pieces of the outside ring.

FIG. 31 is a top view of a fully assembled circular hoop.

FIG. 32 is a top view of an alternate form of a central connector used in said hoop to engage the flagpole.

FIG. 33 is the central connector of FIG. 32 having a first diameter support removed so that the central connector is capable of engaging a larger diameter flagpole by way of a second diameter support.

FIG. 34 is the central connector of FIG. 33 fixed together and engaged to said larger diameter flagpole.

DETAILED DESCRIPTION OF THE INVENTION

The invention is now discussed with reference to the figures.

Figure 1:
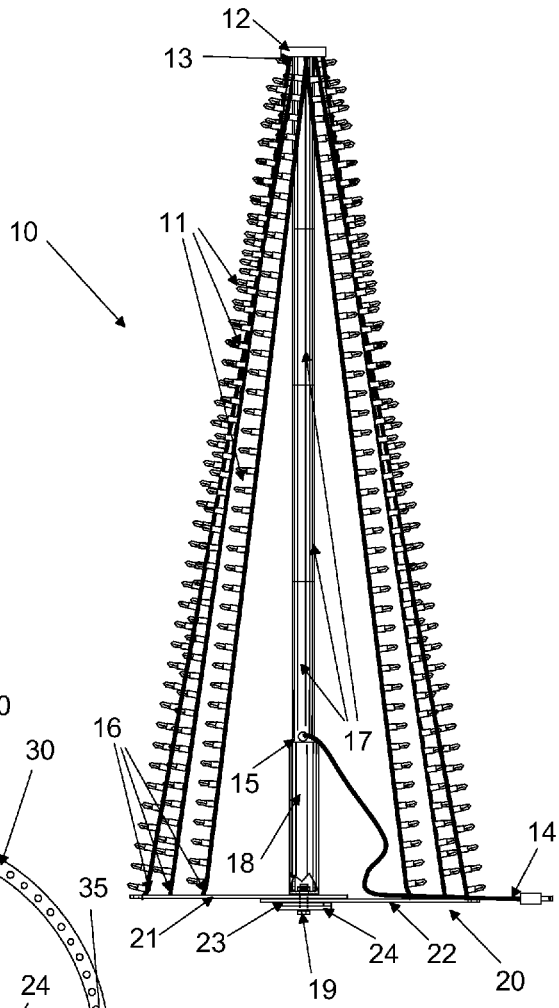
FIG. 1 is a side view of the invention string light type Christmas tree, showing a cutaway portion of a bottom support pipe.

FIG. 1 is a side view of the invention string light type Christmas tree 10 comprising multiple light strings 11 fixed at an upper end to crown piece 12 by their top ends 13 and extending radially outward and down from said crown piece 12 with substantial tension so that light strings 11 connect at distal and releasable ends 16 to a circumference of a round base 20. Round base 20 comprises four flat panel sections 21, 22, 23 and 24 rotatable about an axis generally located at connector bolt 19, showing a cutaway portion of a bottom support pipe. Bolt 19 secures bottom support pipe 18 to said axis of the flat panel sections 21-24 by way of a bottom plate. Pipe 18 comprises a bore with an upward directed opening to receive a lowest section of sections 17 which form a vertical support pole and which are capable of being assembled and disassembled to form it. The bottom support pipe supports the vertical support pole in a vertical position so that it extends upward for support of the crown piece 12. Crown piece 12 comprises means for electrically connecting the upper ends of light strings 11 and thereafter connecting them with two wire plug connector 14, which extends through bores of sections 17 and out opening 15.

It should be understood that flat panel sections as shown in the drawing figures are a representation of a rectangular structure with equivalents by way of a rectangular frame formed of metal tubes or bar stock defining a rectangular space within said frame. Other flattened, rectangular structures may be designed by one skilled in the art by way of the present disclosure.

Figure 2:
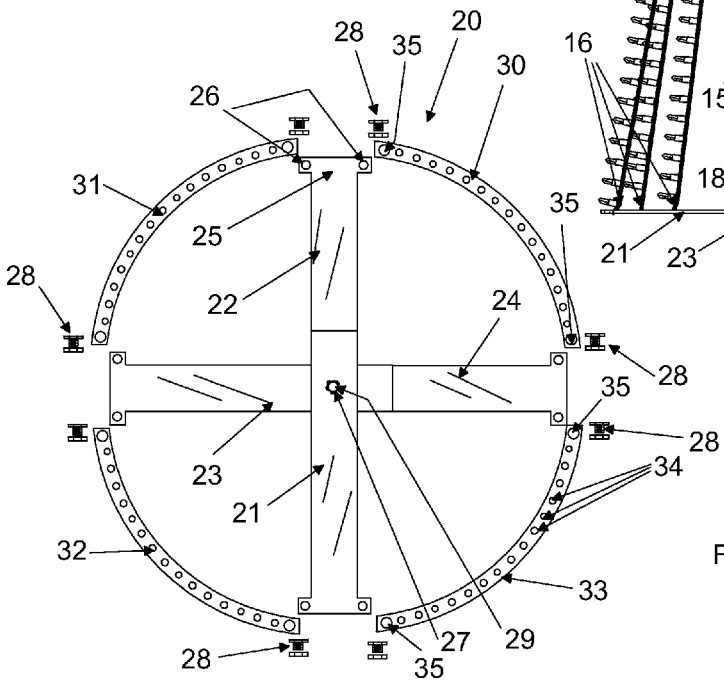
FIG. 2 is a top and exploded view of the arc sections and flat panel sections of the invention round base, including holes for connection of string light ends.

FIG. 2 shows a top and exploded view of four arc sections 30, 31, 32 and 33 which comprise a flat plate or rounded bar cross section and, in plane view, comprise an arc which is less than one fourth of an arc of a circle. Flat panel sections 21, 22, 23 and 24 each are approximately the same in size, shape and construction and comprise a flat plane section extending outward from a central axis connection 27 defining hole 29 to a terminal T-shaped arc end 25 which defines bolt holes 26 in short, lateral, arc-directed extensions. Arc ends 25 comprise a substantial portion of a circumference of a circle for round base 20 formed when arc sections 30, 31, 32 and 33 are joined by bolts 28 by their bolt holes 35 to the bolt holes 26 of the arc ends 25. It is critical to the invention that arc ends comprise a substantial portion of said circumference of the round base. Arc sections 30, 31, 32 and 33 are shown in FIG. 2 with light string hook holes 34, which are adapted to receive plastic or metal hooks attached to lower ends of the light strings 11 of FIG. 1 so that said light strings are properly tensioned to achieve assembly of the invention tree.

Figure 3:
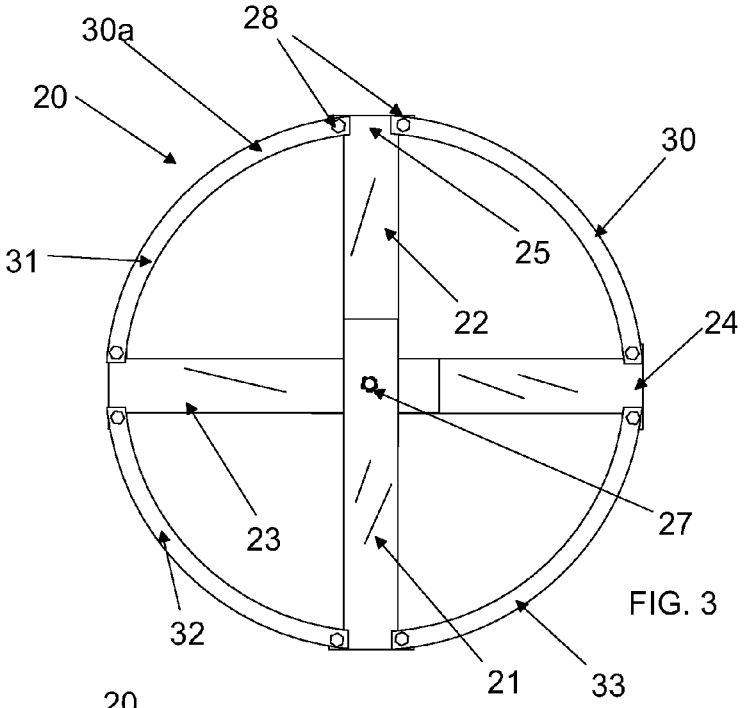
FIG. 3 is a top view of the sections of FIG. 2 assembled as a round base.

FIG. 3 shows circumference 30*a* of an assembled round base 20 comprising arc sections 30, 31, 32 and 33 and arc ends 25. Bolts 28 are shown joining the arc sections to the arc ends. When assembled as shown in FIG. 3, round base 20 forms a strong, rigid, planar structure upon which vertical extensions may be supported, preferably from the rotating axis at rotatable connection 27. Connection 27 preferably comprises rivet means which allow 360 degree rotation of flat panel sections 21, 22, 23 and 24 about the rotating axis but which provide structural compression of said flat panel sections so that they resist out-of floor plane rotation.

Figure 4:
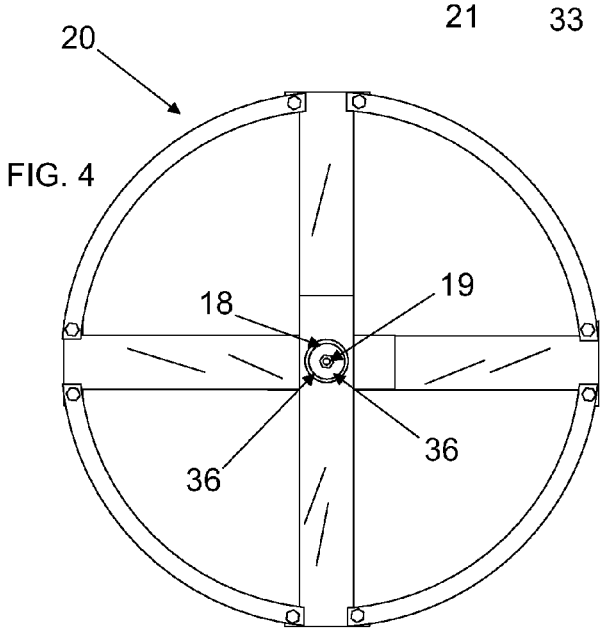
FIG. 4 is the round base of FIG. 3 having the bottom support pipe connected to a pivot axis of the four flat panel sections.
Figure 5:
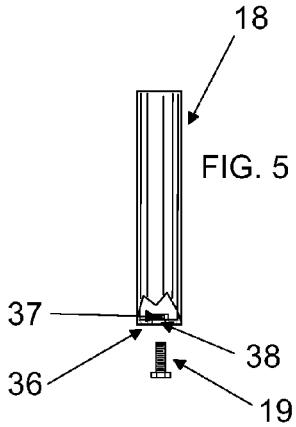
FIG. 5 is a close-up view of the bottom support pipe of FIG. 1 with its connector bolt removed.

FIG. 4 shows connection by bolt 19 of bottom support pipe 18 to the round base 20 at a bottom plate 34 located at the bottom of the bore of bottom support pipe 18. FIG. 5 shows further detail of that connection, i.e., a nut 37 is fixed about opening 38 of bottom plate 36 to receive an end of bolt 19. Bolt 19 is adapted to pass through the opening of rotatable connection 27 of FIG. 3 and through opening 38 to nut 37. Other connection means for a vertical support pole to the location of the rotatable connection 27 are contemplated by the invention, i.e., a short threaded pipe can extend upward which is threadedly connected to a lowest section of the sections of a vertical support pole or interlocking slots and extensions may be formed on an interface between the bottom plate 36 of bottom pipe 18 and the area of the rotatable connection 27.

Figure 6:
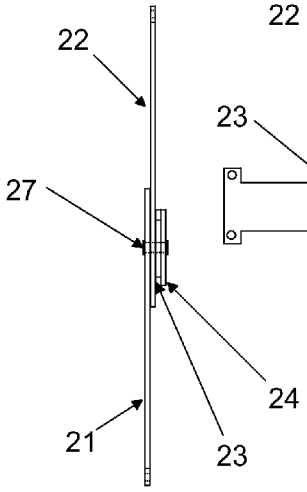
FIG. 6 is a side view of the four flat panel sections of FIG. 2.
Figure 7:
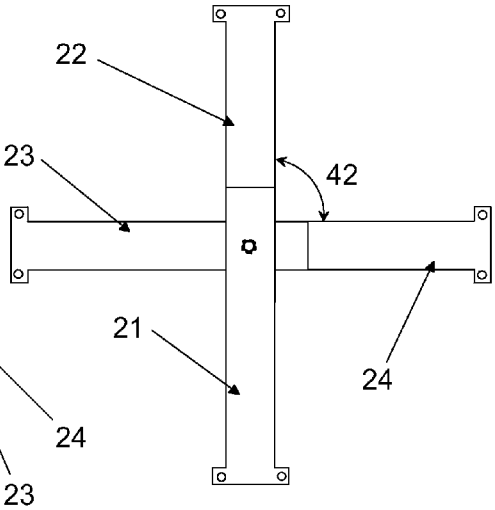
FIG. 7 is a top view of the four flat panel sections of FIG. 2 showing rotation angles for moving those sections to a folded up state.
Figure 9:
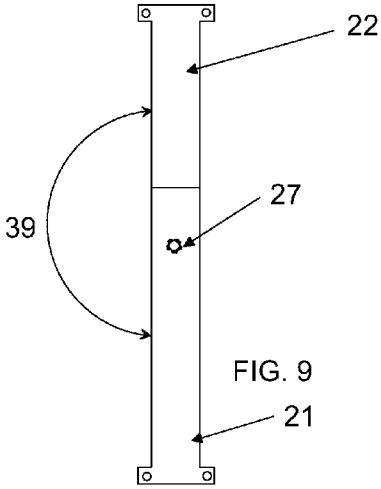
FIG. 9 is a top view of the flat panel sections of FIG. 7 or 8 moved into a first folding position for the flat panel sections.

FIG. 6 is a side view of the four flat panel sections 21, 22, 23 and 24 of FIG. 2 showing rotatable connection 27 in broken lines. FIG. 7 is a top view of the four flat panel sections 21, 22, 23 and 24 of FIGS. 2 and 6, showing rotation angle 42 whereby flat panel sections 23 and 24 are moved from a fully extended position to a first folded up position behind flat panel sections 21 and 22, as in FIG. 9.

Figure 8:
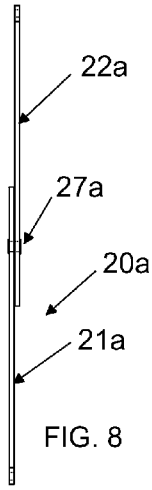
FIG. 8 is an alternate embodiment of two flat panel section pivotally joined as opposed to four such sections shown joined in FIG. 7.

In an alternate embodiment, the structure shown in FIG. 8 can be constructed by way of two sets of two flat panel sections 21*a* and 22*a* joined at rotatable connection 27*a* arranged in the X-shaped assembly shown in FIG. 7.

In yet another embodiment, four separated flat panel sections are not joined at all until fixed together by way of bolt 19 as in FIG. 4.

Figure 10:
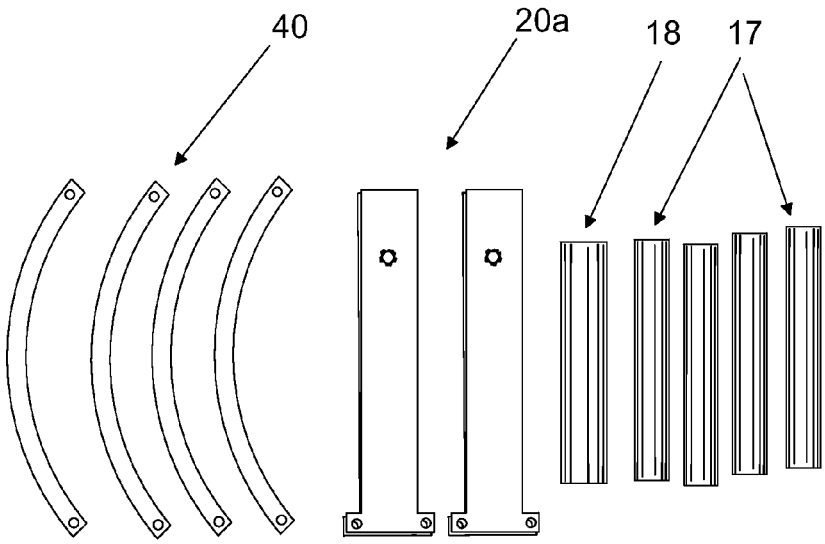
FIG. 10 is a top view of the elements of the disassembled round base, bottom support pipe, and sections of the vertical support pipe arranged separately on a tabletop.

In either of the embodiments using two sets of two joined flat panel sections or where four flat panel sections are all rotatably joined, flat panel sections 21 and 22 (and those located hidden beneath them) are rotated along path 39 so that flat panel section 22 is folded under flat panel section 21, as shown for folded down flat panels 20*a* of FIG. 10.

FIG. 10 shows the basic pieces of the round base and a vertical support pole and its connection means to the round base. Four identical arc sections 40 shown next to folded down flat panel sections 20*a*, bottom support pipe 17 and vertical support pole sections 17.

Figure 11:
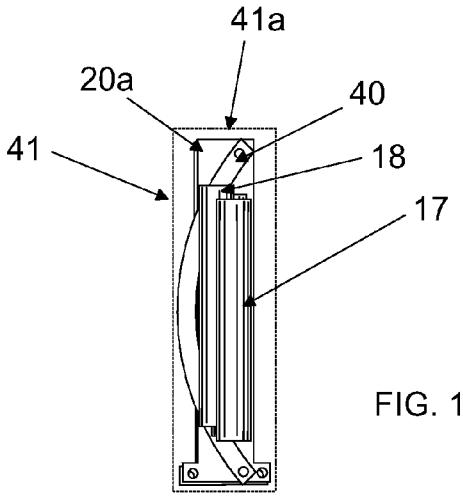
FIG. 11 is a top view of the elements of FIG. 10 shown contained in a rectangular packaging space (in broken lines).

FIG. 11 shows the form factor outline 41 of a rectangular storage volume for the four identical arc sections 40, folded down flat panel sections 20*a*, bottom support pipe 17 and vertical support pole sections 17. The required width 41*a* of storage volume 41 is dramatically reduced over that of the prior art due to forming a portion of the circumference 20*a* of FIG. 3 with four arc sections and partly with arc ends of the flat panel sections. In addition, an out of page elevation of storage volume 41 is reduced over the prior by use of flat metal sheets for the flat panel sections that rotate or fold together into the plane view form factor of only one of the flat panel sections.

The invention also comprises an alternate embodiment using a vertically folding center portion. FIG. 12 is a top perspective view of the vertically folding round base 50 for a light strand Christmas tree, comprising a central portion having preferably four (or three or more) collapsible arms 52 connected by pivot pins to a pole support 53, the center portion being releasably connectable to an outside ring comprised of a number of releasably connectable arc pieces 51 equal to the number of arms 52.

The outside ring forms a circle, where arc pieces 51 have insertion ends 54 (in hidden lines) and receiving ends 55. FIG. 12 shows that four arc pieces are connected to form a circular support circumference for base 50. The center portion comprises four arms 52 each having members 56, 57 and 58. Pole support 53 comprises a tube 65 with four vertical flanges 64 at 90 degree angles to each adjacent flange 64. Arms 52 are pivotally connected to pole support 53 at pivot pins connections 62 and 63 respectively to members 58 and 56. Members 57 and 58 form a horizontal part of arm 52, being connected at pivot pin connection 61. Member 57 in a preferred embodiment is about 10-11 times the length of member 58 to accomplish the folding up objects of the invention. Member 56 is connected at pivot pin connection 60. Member 56, in a preferred embodiment, is angled upward from horizontal from connection 60 by about 3-10 degrees, more preferably about 5 degrees, so that member 56 is pivotally connected by pivot pin connection 63 to a top end of flange 64. The center portion's construction provides that the four arms can be folded so that member 57 moves from a horizontal, radially outward position relative to pole support 53 in an open position to a vertical, downward directed position parallel with pole support 53 in a closed position.

In the open position shown in FIG. 12, the center portion is disconnected from arc pieces 51 and elevated slightly showing holes in arc pieces 51 and on a turned down end 69 of member 57 adapted to receive bolt 66 to secure the ends 69 to arc pieces 51.

FIG. 13 shows that connection of bolt 66 joining end 69 to an insertion end 54*a* of arc piece 52*a* and to a receiving end 55*b* of arc piece 52*b*. Slot 70 in end 69 allows for wide tolerance in aligning end 60 with joined ends 54*a* and 55*b* in actual assembly. Also shown an exemplary end of a light strand 72 bearing an LED assembly 73 electrically connected to supporting strands of narrow gauge insulated electrical wire with a cord extension 74 from assembly 73 terminating in a hook piece 75 with hook 76 extending downward and inserted into hole 77 in an outer edge of arc piece 51*a*. The cord extension 74 may comprise an elastic band material or a metal spring to provide for sufficient tension on the length of each individual light string to maintain a relatively straight light strand 72 from the top of the tree assembly to the round base.

FIG. 14 shows insertion end 54*a* is a smaller diameter tube extension from a larger diameter tube forming the main body of the arc piece 51*a*, where receiving end 55*b* comprises an opening at the other end of the main body of the tube to receiving an insertion end. Two vertically aligned holes 71 in insertion end 54*a* and also in receiving end 55*b* are adapted to be vertically aligned when insertion end 54*a* is inserted into receiving end 55*b*, as shown in FIG. 13, so that bolt 66 passes through them to secure said ends 69, 54*a* and 55*b* together.

Figure 15:
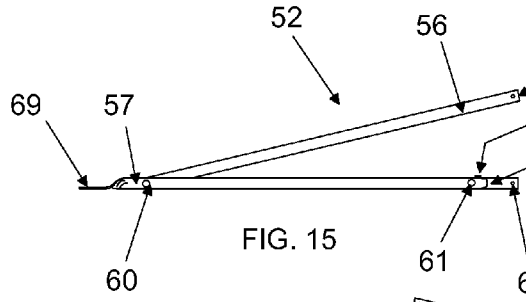
FIGS. 15 and 16 respectively show right and left side views of an individual arm of the center portion of FIG. 12.
Figure 16:
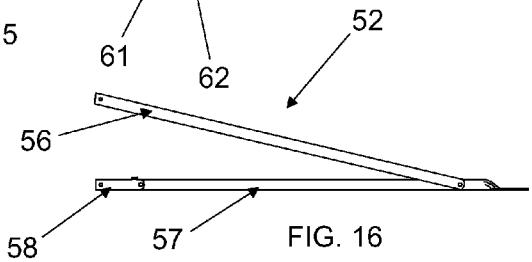

FIGS. 15 and 16 respectively show right and left side views of an individual arm 52 of the center portion of FIG. 12 identifying aspects disclosed above.

Figure 17:
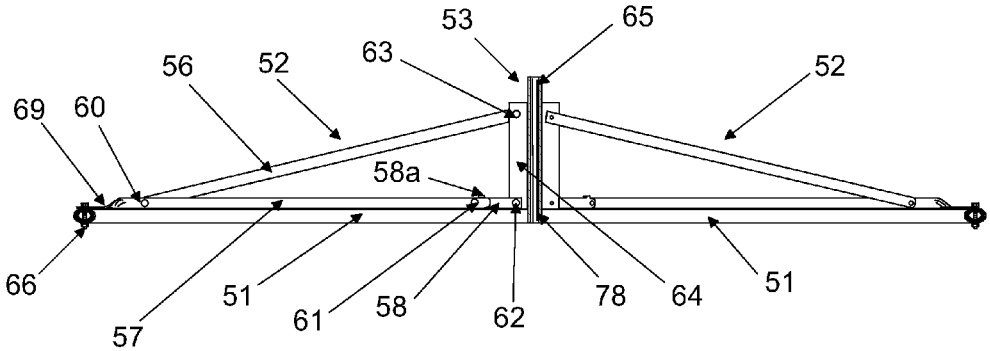
FIG. 17 is a broken away view of a fully assembled round base as in FIG. 12.

FIG. 17 is a broken away view of a fully assembled round base 50, where arms 52 are releasably secured to arc pieces 51 and are also to pole support 53. Tube 65 extends from end 78. End 78 is adapted to rest upon a horizontal surface with a lowest surface of arc pieces 51 to form the entire contact surface between base 50 and a supporting floor. The entire center portion is adapted to be elevated above said floor in the assembled and open position by way of its pivot pin connections 62 to flanges 64, the end 69 connection to the outside ring and a stop piece 58*a* extending from a top edge of member 58 over a top edge of member 57. The location of pivot pin connection 62 is adapted to be elevated above said floor level so that support of end 69 on the outside ring provides for a substantially horizontal alignment of members 57 and 58 in an assembled and opened position of base 50. Tube 53 is adapted to receive a connectable section 17 of FIG. 17 so that said sections 17 can be assembled to form a vertical pole, from which light strands extend down and radially for connection to the outer ring of base 50.

Figure 18:
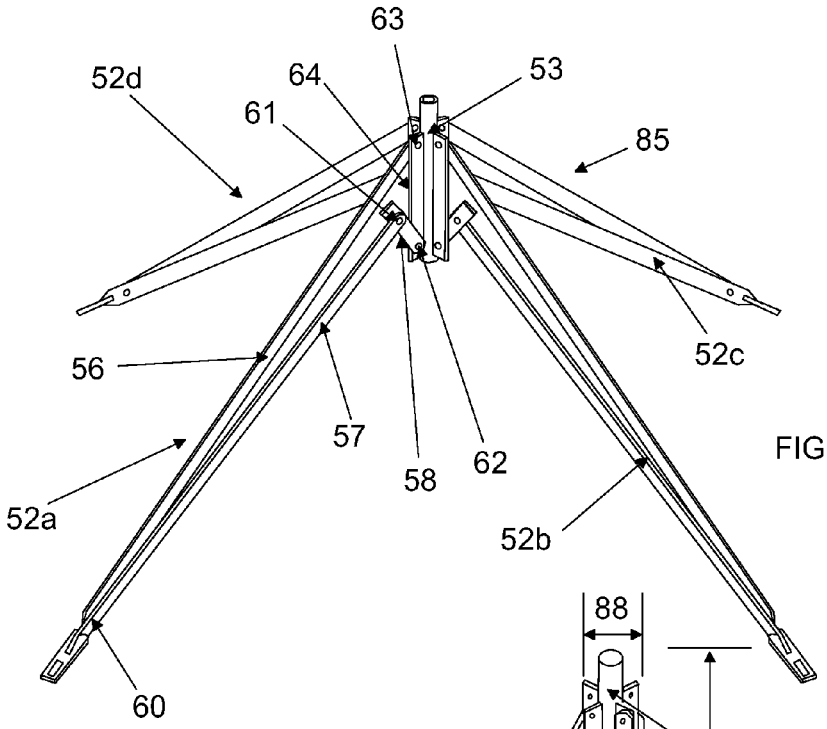
FIG. 18 is top perspective view of the center portion of FIG. 12 disconnected from the outside ring partially vertically folded up.
Figure 19:
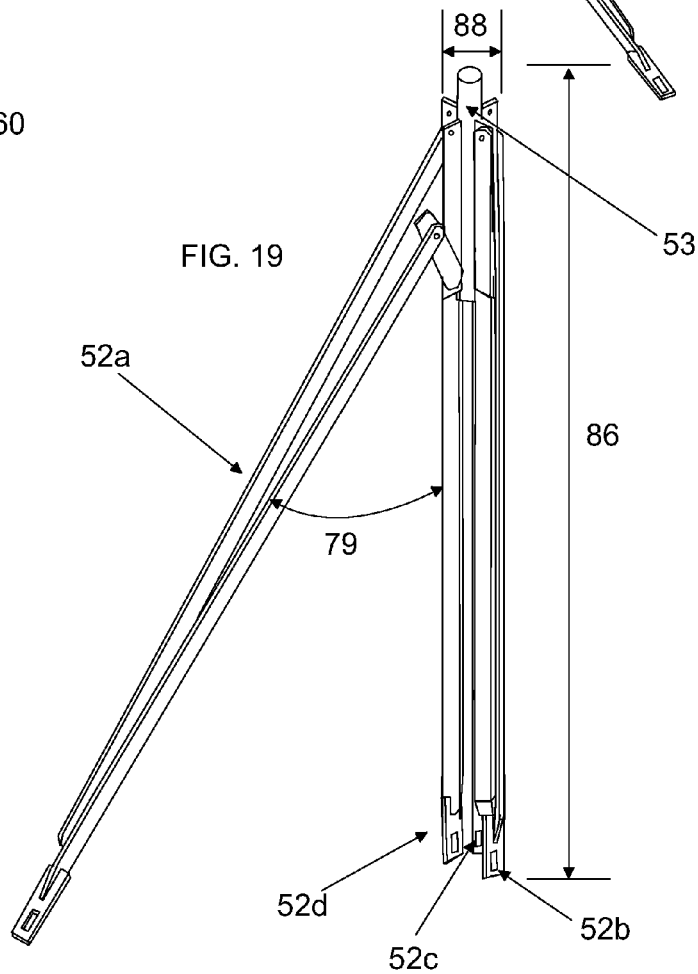
FIG. 19 is the center portion of FIG. 18 where three of the arms have been moved into a fully folded up position.

FIG. 18 is top perspective view of the center portion 85 of FIG. 12 disconnected from the outside ring. Arms 52*a-d* are partially vertically folded up, where members 57 and 58 form an downward acute angle at pivot pin connection 61 and member 58 and flange 64 form an upward acute angle at pivot pin connection 62. FIG. 19 is the center portion of FIG. 18 where arms 51*b-d* have been moved into a fully folded up position. Arm 52*a* is shown movable in direction 79 so that it is moved into a fully folded up position. In a fully folded up position where the center portion 85 has four arms, the center portion 85 has an overall length 86 less than an end-to-end chord distance between ends of arc pieces 51 of FIG. 20. This is true if the number of arms of the center portion are three, four, or five. The extremely compact diameter 88 of the fully closed center portion, in combination with the length 86 reduces packaging volume requirements over the prior art, as shown in FIG. 19.

Figure 20:
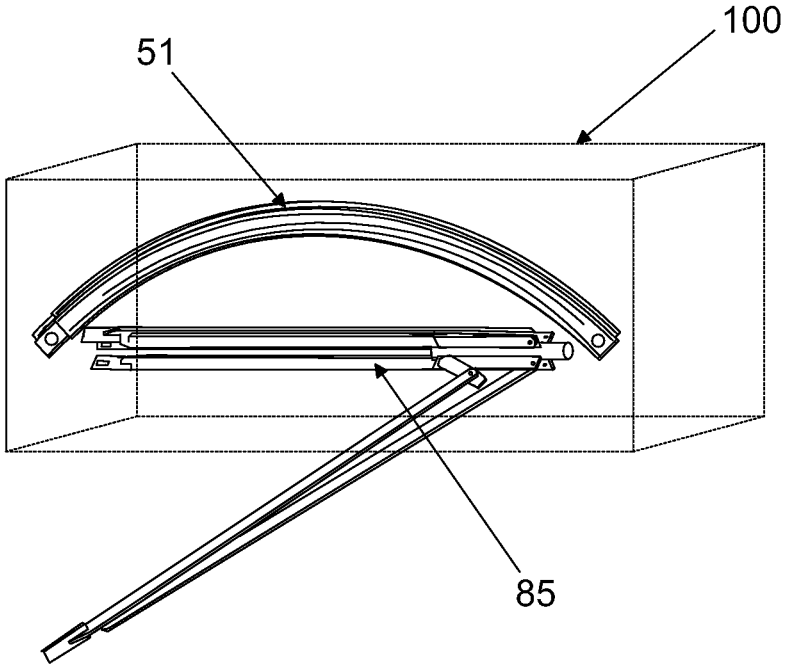
FIG. 20 is the center portion of FIG. 19 shown with four disassembled arc pieces of the outside ring compactly contained within a broken outline of a containing box.

FIG. 20 is the center portion of FIG. 19 shown with four disassembled and adjacently stacked arc pieces 51. The effective diameter of the center portion 85 is somewhat less than the stacked height of the arc pieces, which define a concave space within which the center portion 51, light strands of lights (in FIG. 1), and tubes 17 (in FIG. 17) can be generally contained. Therefore, a containing box 100 is needed only define an internal rectangular space with a length about the chord length of arc pieces 51, a depth of about their stacked height, and a box height with an elevation from the arc piece end-to-end chords to the highest point of the arc piece. Box 100 is much more compact and space saving than the containers of the prior art to provide a center portion capable of being moved from a closed to open position in a single motion.

The embodiment of FIGS. 12-20 is so stable that the diameter of the outer ring can be less than 40 percent of the height of the light strand Christmas tree. In an actual construction, an outer ring has a diameter of 45 inches, a pole support tube height of about seven inches, and a support pole elevation of 120 inches.

An further embodiment of the invention is a combined structure of a commercial height flagpole adapted to raise to a topmost level and support thereat a string light type Christmas tree that extends to a lower part of the flagpole above the ground level to give the impression of a conical Christmas tree. In the past, such structures have not been available to owners of such tall flagpoles (typically 10 feet or greater) due to the hazard and/or expense of raising a person to the upper portion of the flagpole for securing a crown connector of such strings of lights. The present embodiment of the invention provides for means for securing an open gap crown connector to a clip or fastener intended for securing a flag to the flagpole. The securing step of fixing the gapped crown connector to said flag fastener takes place at or near the ground level where a flag is typically fixed to said fastener. A rope or wire and pulley means are provided with all such tall flagpoles so that a person at ground level can draw said fastener and its attached load to a topmost level of the flagpole. A user of this embodiment of the invention will fix the gapped crown connector to said flag fastener and draw to said topmost level the crown connector, raising with the crown connector all the strings of lights in a distribution, as seen in a top view, radially outward from the crown connector with each radius string of lights forming about the same acute angle with each adjacent string of lights.

A circular hoop includes a round outer frame rigidly connected by radial arms from a central connector that engages by circumferential enclosure with but does not become fixed to a lower part of the flagpole. This overall structure provides a very stable and wind-resistant presentation of a lighted Christmas tree with little weight or procedural difficulty. In addition, the large and dramatic presentation obtained by use of this embodiment of the invention is capable of being stored in a relatively small volume at the end of the holiday season.

Figure 21:
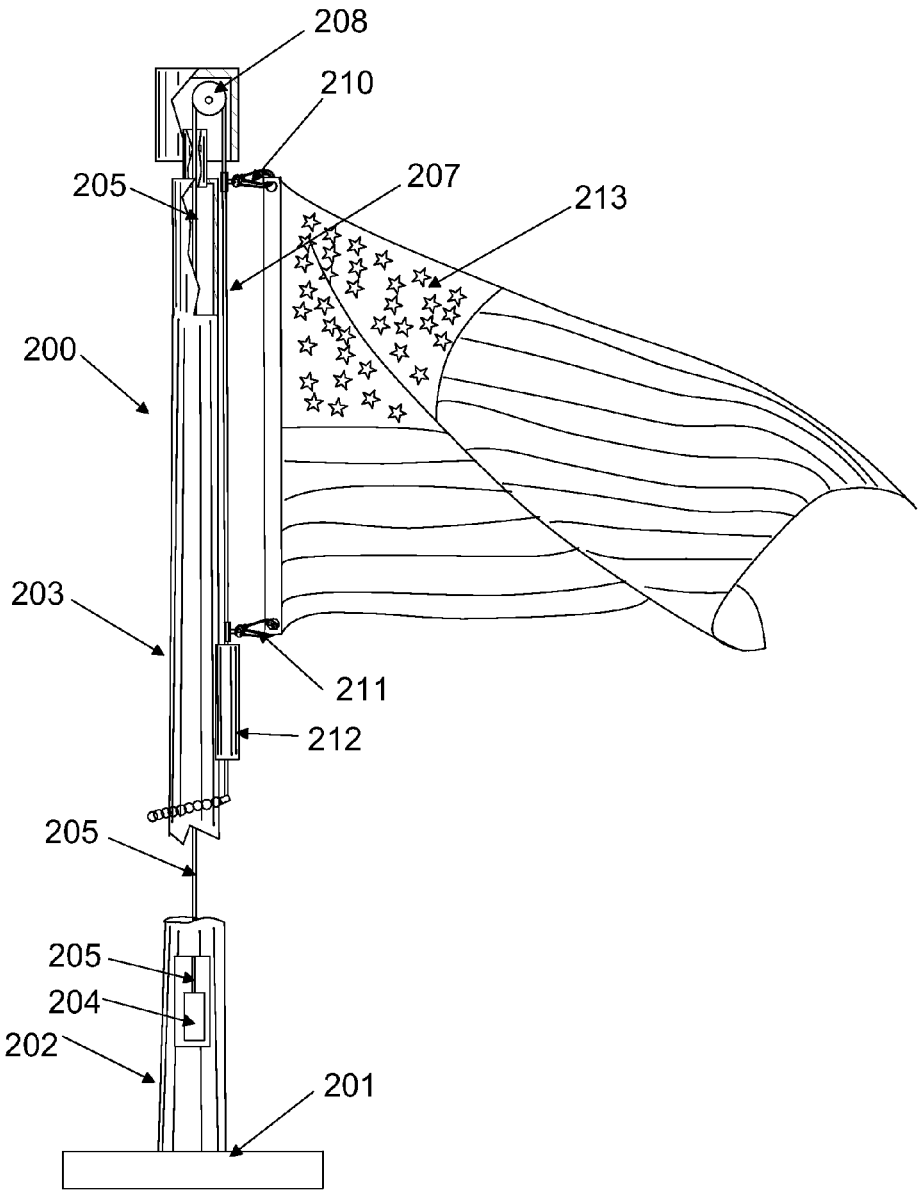
FIG. 21 PRIOR ART
FIG. 21 is a front view of a prior art flagpole with a flag in a raised position and a top portion of the flagpole broken away so that an internal pulley (sheavey) and flag raising rope or wire is exposed to illustrate its functions.

FIG. 21 shows a prior art flagpole 200 comprising a ground securing base 201, from which extends vertically a lower part 202 and an upper part 203. A portion of upper part 203 is broken away to show a commonly available internal means for raising or lowering flag 213, which is fixed by fasteners 210 and 211 to generally uniformly, where such a flagpole is impractically tall for direct installation of a crown connector at an upper end of the "tree". In this form of the invention, the crown connector is raised to a topmost position on the flagpole by way of the rope and pulley available for raising and lowering a flag on the flagpole. In a preferred structure and process, multiple strings of Christmas lights extend from upper connections at the crown connector to lower connections at arc segments of a circular hoop. When the crown connector is raised to a topmost position, said strings of lights are necessarily raised with it, leaving said arc sections dangling from the lower connections. In this position, the strings of lights form a rather dense drape close to most of the length of the flagpole. A user proceeds to assemble said arc lengths into said circular hoop, forcing the lower connections of the strings of lights from a generally vertical direction into approximately the same acute angle with reference to the vertical flagpole.

In the fully installed mode for the flagpole embodiment of the invention, adjacent strings of lights are arranged generally equidistant as to their upper connections on the crown connector and as to their lower connections on the circular hoop, thereby resulting, when the hoop is assembled, in a conic structure approximating a Christmas tree shape defined by the lights on the strings of lights when the surroundings are sufficiently dark enough to see them when lighted. The strings of lights are essentially equal in length and are provided with elastic means for causing them to be maintained in a substantially straight line in the installed position.

Referring again to FIG. 21, rope 205 extends from user raising means 204 at lower section 202 up internal to lower section 202 and upper section 203, over pulley 108, and down to engagement section 207. Section 207 comprises fasteners 210 and 211 as described above.

Figure 22:
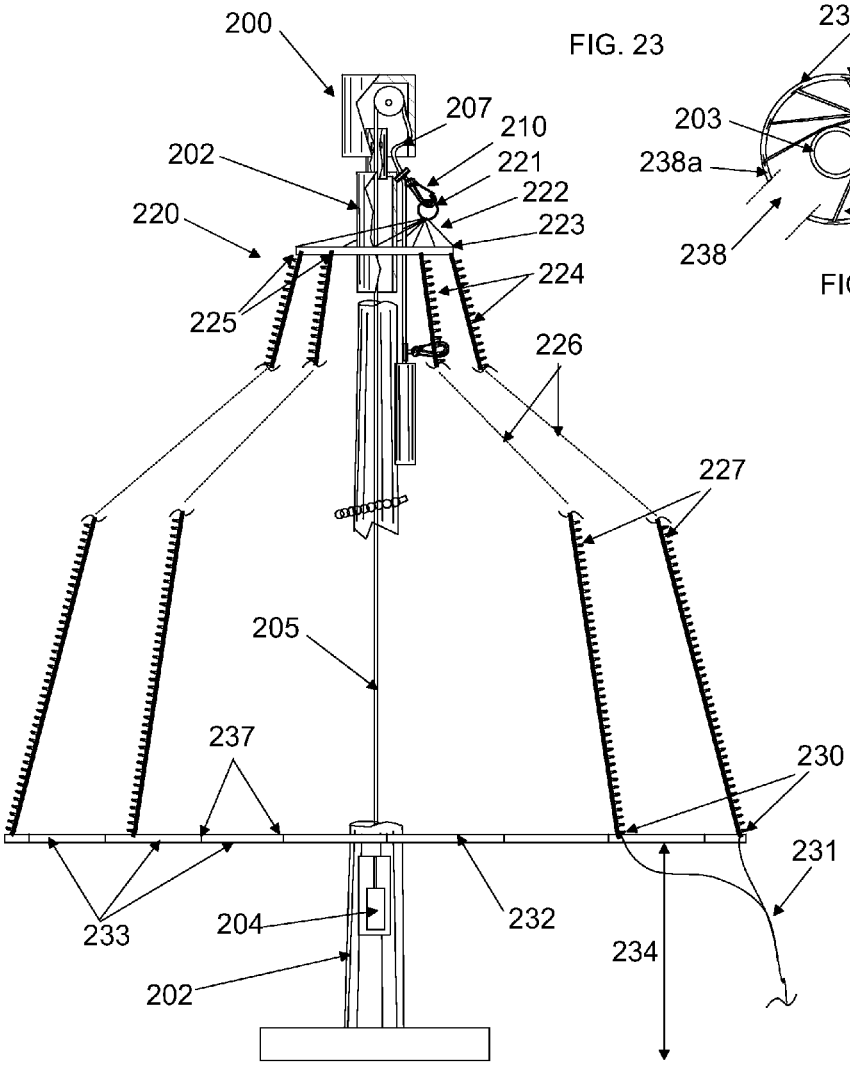
FIG. 22 is the front view of the flagpole of FIG. 21 with the flag removed and a crown connector of the invention string light type Christmas tree shown supported at a topmost level and a circular hoop at a lowest level, whereby strings of Christmas lights extend in a substantially straight line from their upper connection on the crown connector to their lower connection at the hoop.

FIG. 22 is the front view of the flagpole 200 of FIG. 21 with the flagpole embodiment 220 in a fully installed mode as to flagpole 200. A crown connector comprises split ring 223 supported from fastener ring 221 by strands 222, where said crown connector also comprises connection means 225 for upper ends of light strings 224. Thus, split ring 223 of said crown connector provides for a substantially horizontal support for upper ends of light strings 224 by providing variable lengths of strands 222 connected to ring 221, which is turn fastened fastener 210 at one side of upper section 203. Split ring 223 defines an annular space between itself and an outside surface of upper section 203, whereby split ring 223 is capable of freely moving up and down the vertical length of flagpole 200 when engagement section 207 is raised or lowered when a user interacts with rope 205 through user raising means 204 at lower section 202. FIG. 22 shows fastener 210 at its greatest height, which is necessarily the greatest height achievable for split ring 223. Light strings 224 preferable comprise small lights spaced apart along their entire lengths so that the eventual visual effect of the lighted light strings 224 provide the tallest possible lighted image. Light strings 224 are shown with interrupted sections 226 extending to base sections 227 to show that said light strings may extend to the great heights typical of commercial flagpoles from lower section 202.

FIG. 22 shows that flagpole embodiment 220 includes a circular hoop 232 comprising arc sections 233 joined at securing means 237, where means 237 allows a user to disconnect each of arc sections 233 from each other in a manner described above for another embodiment of the invention. Hoop 232 is maintained substantially horizontal to the ground at a relatively short distance 134 from the ground. Maintaining split ring 223 and hoop 132 substantially horizontal is important to creating the conic lighted structure responsible for the visual illusion that the flagpole embodiment 220 is a lighted Christmas tree, albeit one supported by a flagpole. Further, an effective diameter of split ring 223 is at least one half or less than an effective diameter of hoop 232 to provide such a conic lighted structure. Each of string lights 224 supported at connection means 225 at split ring 223 extend downward and outward from flagpole 200 with essentially the same length and angle relative to flagpole 200 to connect with hoop 232 at securing means 237.

From examination of FIG. 22, it is instantly appreciated that the entire structure supported from fastener 210 at ring 221 may be lowered toward ground level by releasing rope 205 at raising means 204 or vice versa. It will also be appreciated that when the ends of light strings 224 contact the ground surrounding flagpole 200 that they will simple aggregate in a pattern similar to flexible rope for later gathering. When ring 221 reaches a level at which a user can reach fastener 210, a user can disengage ring 221 from fastener 210. In reverse, a user can attach ring 221 to fastener 210 and raise split ring 223 to the level shown in FIG. 22, thereby causing light strings 224 to assume the positions shown in FIG. 22. It is preferred that sufficient light strings 224 be provided in the flagpole embodiment 220 so that their securing means 237 be uniformly from one to three feet apart along the outer round frame of hoop 232. Electrical connection means 231 are provided for connection of light strings 224 to electrical power.

Figure 23:
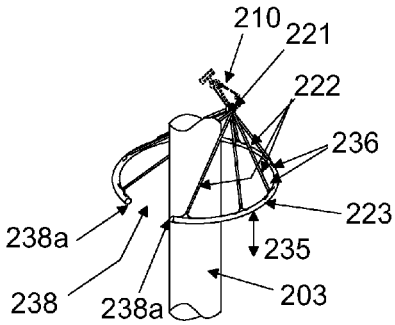
FIGS. 23 and 24, are, respectively, a top perspective view and a top view of the crown connector of FIG. 22 with the strings of lights removed.
Figure 24:
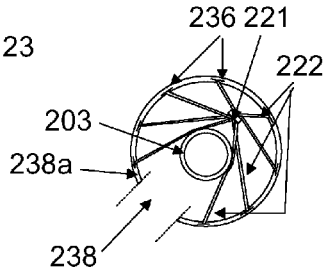

FIGS. 23 and 24, are, respectively, a top perspective view and a top view of said crown connector of FIG. 22 with the light strings removed to illustrate that strands 222 connect at points 236 on split ring 223 with variable lengths adapted to provide a substantially horizontal orientation at a distance 235 above ground level. Ends 238*a* define a gap 238 in split ring 223 so that split ring can be removed from engagement with flagpole 200 at lower section 202 when ring 221 is removed from fastener 210.

Figure 25:
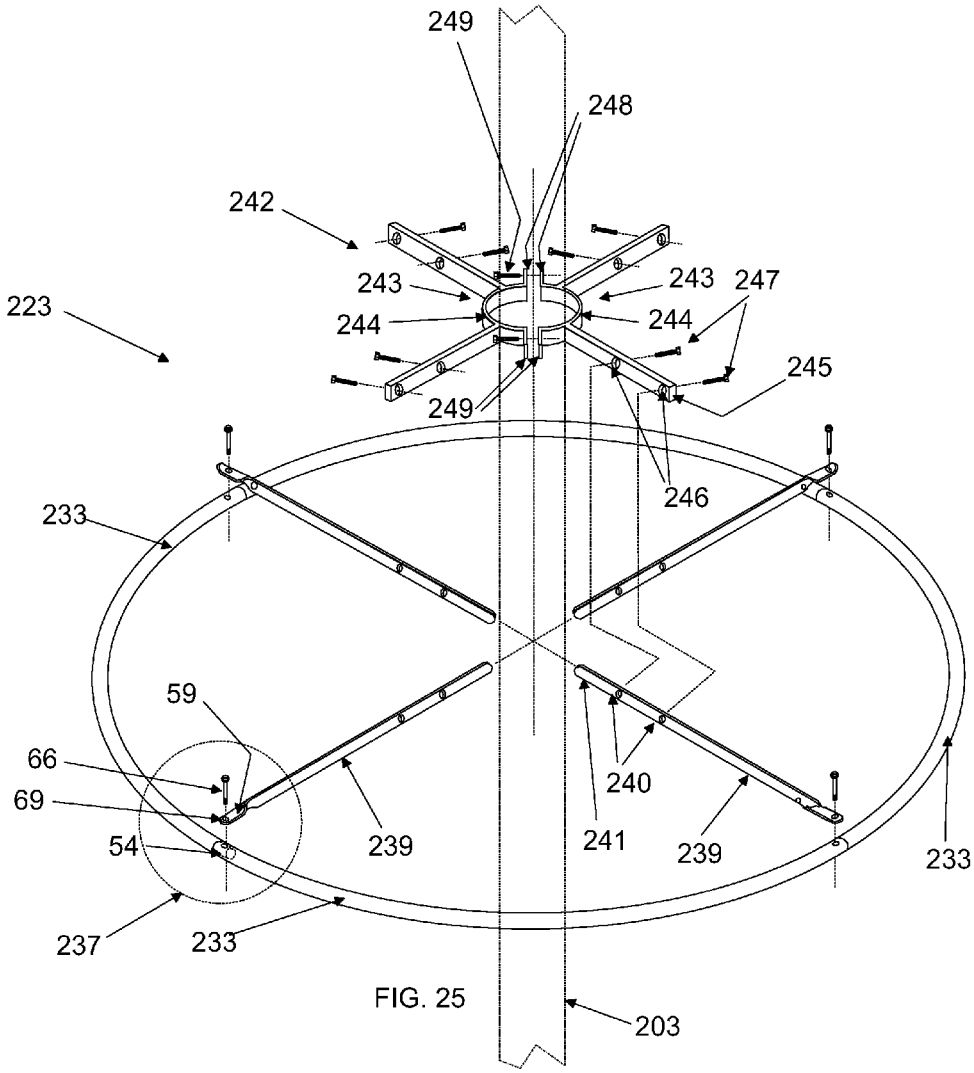
FIG. 25 is a perspective view of a four arc section embodiment of the circular hoop adapted to engage a lower part of the flagpole.
Figures 26, 27:
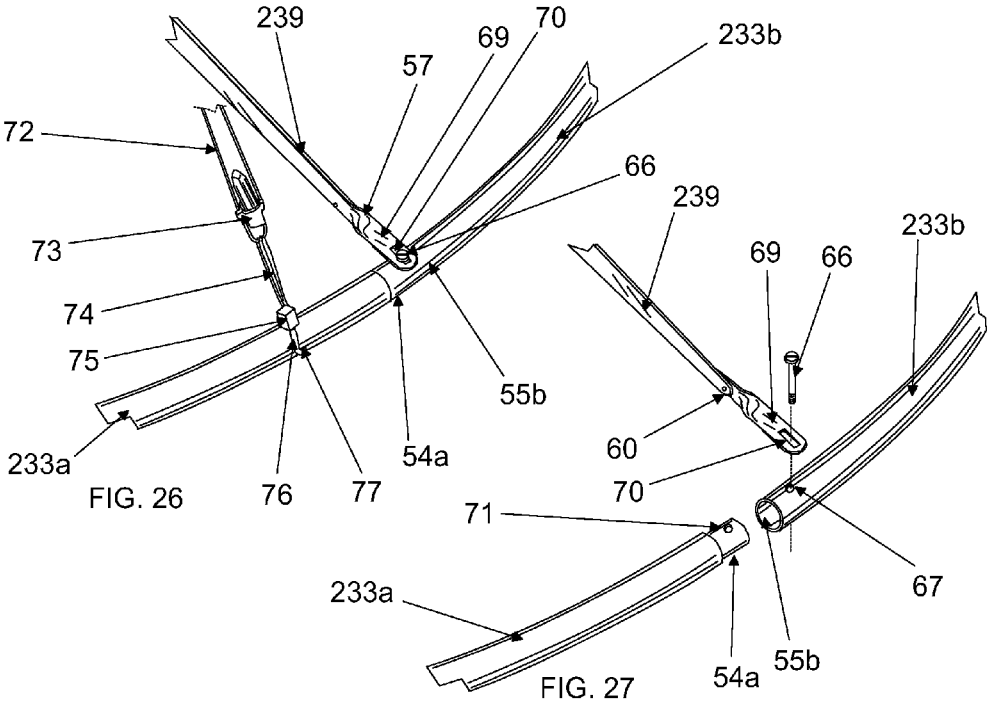
FIG. 26 is a close-up perspective view of engaged ends of said arc sections.
FIG. 27 is an exploded view of the engaged ends of FIG. 26.

FIG. 25 is a perspective and exploded view of a four arc section embodiment of the circular hoop 232 adapted to engage the lower section of the flagpole and to urge outward the light strings extending down from said crown connector. Hoop 232 generally is comprised of a round outer frame formed from arc sections 233 connected to radial arms 239 that extend radially from flagpole connector 242. Arc sections 233 are connectable to each other in a manner described above with insertable end portions and small bolts to form securing means 237. Securing means 237 also provide for a place at which an outer end of radial arms 239 are fixed to the frame formed by arc sections 233. FIGS. 26 and 27 show enlarged views of said securing means 237.

Referring again to FIG. 25, radial arms 239 comprise straight, rigid lengths defining bolt holes 240 close to an end 241 of the arms to be secured to connector 242. Connector 242 comprises at least two parts 243 which are joined at flanges 248 by bolts 249. Parts 243 must be capable of being disengaged and fixed together to engage the lower section 203 (shown in broken lines) by way of two semi-circular bands 244 supporting flanges 248. Radial extensions 245 extend radially from those bands to engage each of the radial arms 239 by aligning bolt holes 246 with bolt holes 240 and joining the extensions 245 and arms 239 with bolts 247. Bands 244 optionally engage lower section 203 securely or loosely. It will be appreciated that joining arc sections 233, radial arms 239 and connector 242 will result in the structure shown in top view in FIG. 31.

Figure 28:
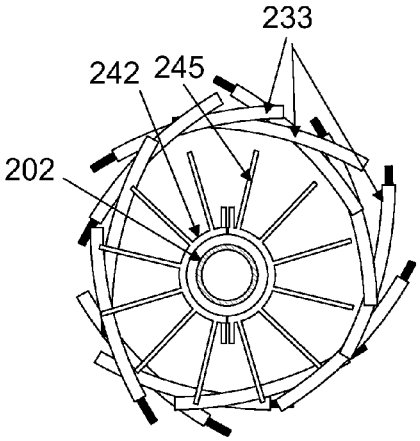
FIGS. 28 and 29 are, respectively, a top (without strings of lights) and a side view of a lower part of a flagpole whereby said crown connector is in a topmost position and disconnected said arc lengths dangle at ends of generally vertical strings of lights prior to assembly.
Figure 29:
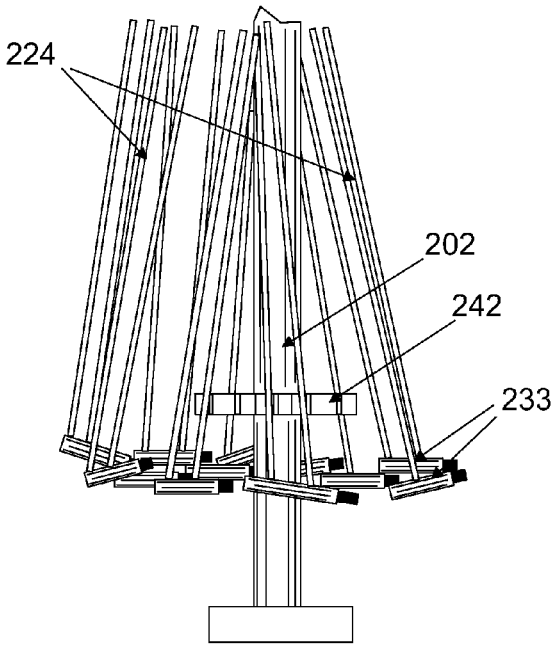

FIGS. 28 and 29 are, respectively, a top view (without strings of lights) and a side view of a lower section 202 with the flagpole embodiment of the invention whereby said crown connector is in a topmost position (not shown) and arc sections 233 dangle at ends of generally vertical light strings 224 prior to assembly of the arc sections into a round frame. Connector 242 is secured to lower section 202 and extensions 245 are available for joining to radial arms.

Figure 30:
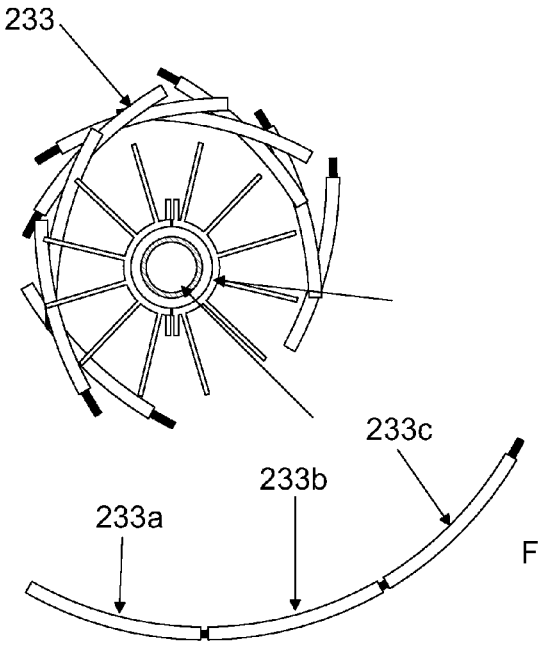
FIG. 30 shows the top view of FIG. 28 whereby three of said arc sections have been assembled.

A description of a user bringing the flagpole embodiment of the invention from a stored state to the position shown in FIGS. 28 and 29 are now described. In stored state, the flagpole embodiment of the invention generally comprises said crown connector lying atop mounded string lights, which in turn lie atop arc sections to which they are attached, all at ground level. The flagpole connector is available in two or more parts. A user then brings the mounded assembly of the crown connector, light strings and arc sections to a base of a flagpole with the rope-fixed fastener available. The user joins the ring of the crown connector to the fastener and causes it to be drawn upward to a topmost position. At this stage, the user will observe that the lower parts of the flagpole embodiment of the invention appear as in FIG. 29. A user then proceeds to join arc sections 233*a, b*, and *c* as shown in FIG. 30, thereafter continuing to join all the appropriate arc sections 233 as shown in FIG. 31. The user would fix the flagpole connector 242 to the flagpole by joining flanges 248 and then join arc sections 233 to the flagpole connector 242 by radial arms 239. At this stage, the flagpole embodiment of the invention appears as shown in FIG. 22.

FIG. 32 is a top view of an alternate form of a flagpole connector of FIG. 25. Referring to FIG. 32, flagpole connector 252 comprises two parts 258, each having flanges 248 and extensions 245 as previously described extending from outer semicircle bands 253. Inward, breakable extensions 257 from bands 253 connect to middle semicircle bands 254, which, in turn have inward, breakable extensions 256 to connect with inner semicircle bands 255. Connector 252 allows a user to apply it to flagpoles with one of three outer diameters. As shown in FIG. 32, connector 252 is capable of engaging a small diameter flagpole 200*a* as defined by an inner diameter across bands 255. FIG. 33 shows a breaking or disengagement of extensions 256 to remove bands 255, thereby providing for connector 252 being capable of engaging a flagpole 200*b* with a larger diameter than flagpole 200*a* of FIG. 32.

Figure 35:
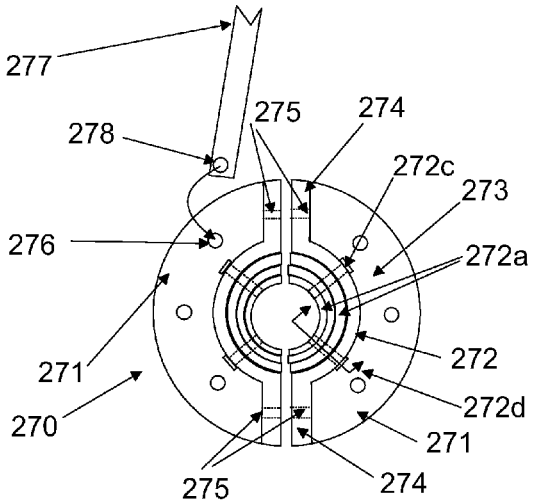
FIG. 35 is a top view of an alternate central connector of the invention.
Figure 35A:
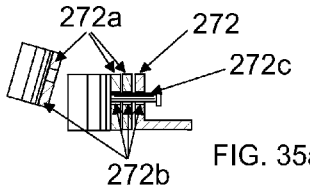
FIG. 35*a* is section 272*d* of FIG. 35.

FIG. 35 is a top view of an alternate central connector 270 which is essentially replaceable of the other central connectors described above, wherein arms 277 comprise bolt holes 278 adapted to receive a bolt securing arm 277 to connector 270 at holes 276. Connector 270 comprises two mirror semicircular halves 271 having an inside collar 272 extending above a level of a base plate defining bolt holes 276 whereby a cylindrical space defined by inside surfaces of collars 272 provides secure connection to a lower section of a flagpole. Flanges 274 define bolt holes 275 for receiving securing bolts to cause halves 271 to be fixed together. Further, connector 270 is enabled to be secured to flagpoles of different diameters by removal of nesting half-sections 272*a*, which are held together by pins 272*c*. FIG. 35*a* shows a section of connector 270 whereby one of a smallest internal diameter half-section 272*a* has been removed after withdrawal of pin 272*c* along aligned bores 272*b* through sections 272*a* and 272.

Figure 36:
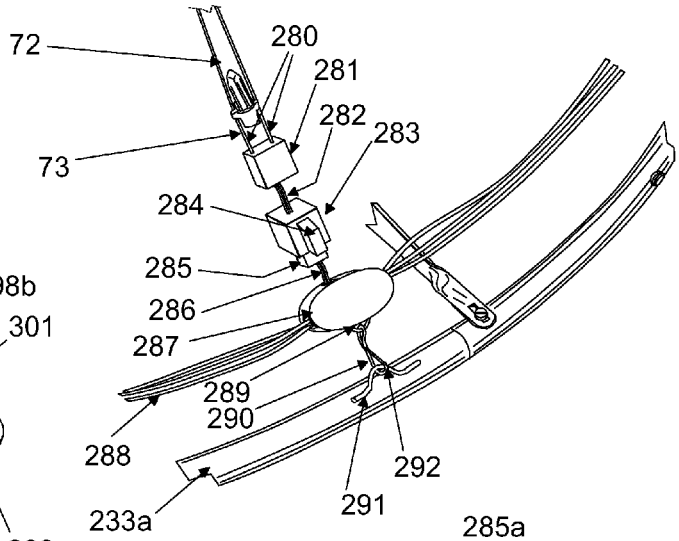
FIG. 36 is a view of a structure similar to that of FIG. 26 showing a replaceable light string.
Figure 36A:
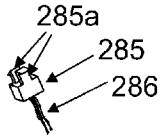
FIG. 36*a* is a view of a removable plug of the structure in FIG. 36.

FIG. 36 is a structure similar to that of FIG. 26 showing a representative replaceable light string where light string 72 extends upward to the crown connector and is attached thereto by a removable hook or latch. At a lower end of light string 72, an assembly 73 extends its electrical wires 280 downward to box 281, whereafter said wires 282 extend down to plug receptacle plug 283, which comprises release means 284 for compression by a user whereby electrical connection plug 285 is released from the secured connection shown in FIG. 36. FIG. 36*a* shows that plug 285 comprises electrical connection prongs 285*a* which electrically extend to wires 286. Referring again to FIG. 36, wires 286 extend to junction box 287, wherein wires 286 electrically connect with base wires 288, which extend about the circumference of the circular frame so that all the light strings are similarly electrically and releasably connected to the circular frame. Junction box 287 at loop 289 is releasably secured to arc section 233*a* of the circular frame by way of latch hook 290 at loop 292 at location 291. A light string exemplified by light string 72 which is burnt out or broken can be removed and replaced by an identical light string by unplugging the plug receptacle 283 from plug 285 at the lower end and unhooking the light string from the crown receptacle at an upper end, thereafter engaging the equivalent structures of the replacement light string in reverse of the disengagement.

Figure 37:
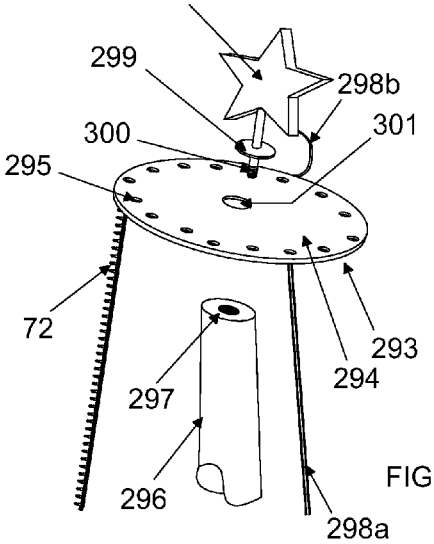
FIG. 37 is a perspective view of an alternate embodiment of a crown connector of the present invention.

It is an alternate embodiment of the invention that the flagpole represented in FIG. 22 be capable of being collapsed by way of telescoping sections to a relatively low elevation, i.e., to one to six feet tall so that a user may reach a top end of the flagpole. In this embodiment, a crown connector may comprise a solid circular ring to from which light strings descend for connection to the outer circular frame of the hoop structure or the crown connector may comprise the split ring connector shown in detail in FIGS. 23 and 24. In FIG. 37, exemplary of an alternate crown connector 293 is generally a circular plate 294 having light string connector holes 295 and a central securing hole 301. An ornament connector 298 is shown with a capital ornament piece (in this case a star, which may be lighted), a threaded post 300 and a base plate 299 about a distance above the threads. The threaded section of post 300 is inserted through hole 301 and threaded into threaded hole 297 at a top end of flagpole 296 so that the entire assembly is secured firmly together to support the crown connector 293 at the top of flagpole 296. Ornament connector 298 is provided with electrical power for lighting of the capital ornament piece by way of bridge wires 298*b* to a wire string 298*a* which connects at a lower section with the light strings of the invention.

Figure 38:
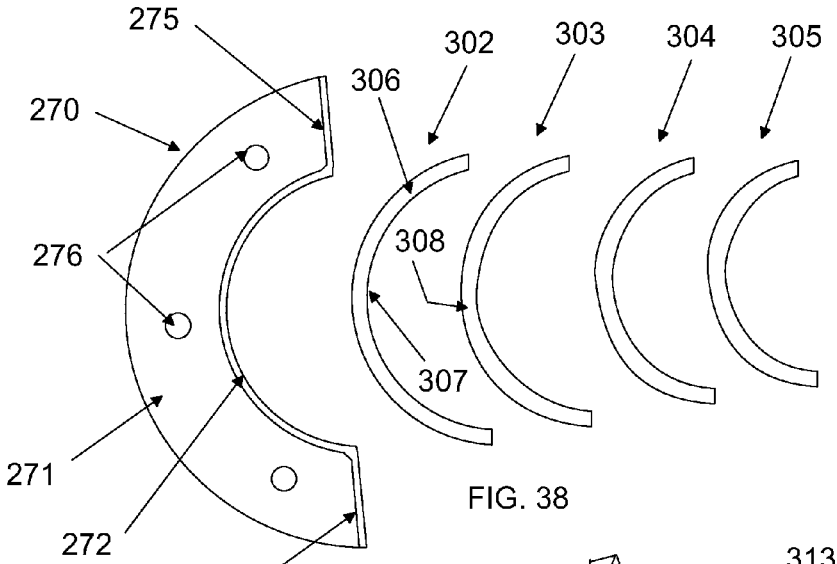
FIG. 38 is a top, exploded view of a central connector similar to that of FIGS. 35 and 35*a*.
Figure 39:
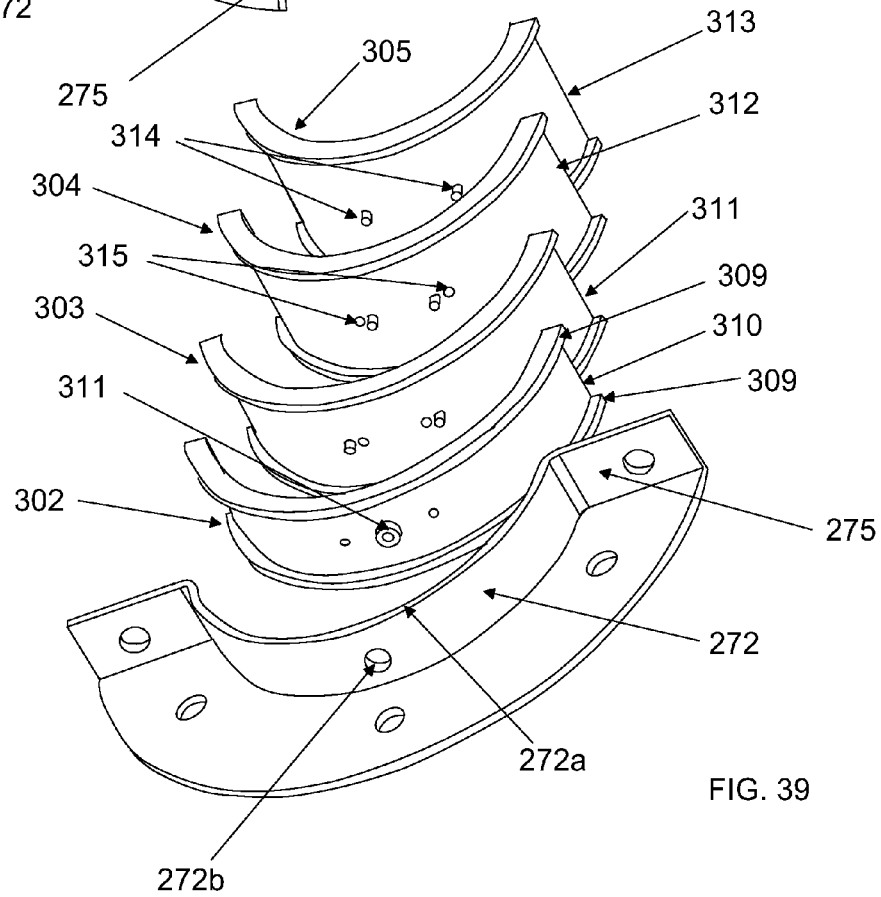
FIG. 39 is an inside, perspective view of the central connector of FIG. 38.

An alternate embodiment of a central connector is now discussed with reference to FIGS. 38 and 39, where said central connector comprises two mirrored structures, one of which is shown in FIGS. 38 and 39. A collar 272 defines a pin opening 272*b* located at a distance below top edge 272*a*. This embodiment provides secure nesting of removable inner collar sections 302, 303, 304, and 305 so that minimal structure is required to maintain them as a secure group when secured to a flagpole as described above. Sections 305 through 302, in that sequence, may be easily removed without special tools from a nesting relationship with the entire Each of sections 302 to 305 comprise a semi-circular collar band 310 from which extends in an outward direction nesting ledges 309. In the case of section 302, band 310 is slightly greater in elevation than the combination of collar 272 and the thickness of the base plate, where ledges 309 for section 302 are adapted to lie adjacent to top edge 272*a* and an underside of the base plate when section 302 is nestedly engaged to the concave, inside facing portion of collar 302. Similarly, the ledges/ convex band portion of section 303 nestingly engages the concave portion of section 302, and so on for sections 304 and 305. It is understood that heights 311, 312 and 313 of, respectively, sections 303, 304 and 305 increase sufficiently to snugly engage the next largest, adjacent section. Further, pins 314 are provided in each of sections 303, 304 and 305 to fit into pin holes 315 of, respectively, sections 302, 303 and 304, providing support for adjacent sections while eliminating a need for a tool to separate said sections.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A string light type imitation Christmas tree kit for installation on and support from a flagpole having pulley means at a top of the flagpole and a rope accessible to a user at ground level for raising or lowering a flag attached to fasteners fixed to said rope, where said kit comprises a circular crown connector and adapted to be raised by connection with said fastener from ground level by way pulling of said rope and multiple light strings connected at one their ends to said crown connector and to another of their ends to a circular hoop means having a diameter two or more times that of the crown connector, so that when said crown connector is raised to a topmost position the circular hoop means are raised off of the ground and said light strings extend outward radially from the flagpole and downward from the crown connector to an outer edge of the circular hoop means to generally define a conical structure which visually appears to be in the shape of a lighted Christmas tree when a power means provides electrical power to the light strings and the light strings comprise flexible wires electrically connecting and bearing small lights, said small lights are arranged at approximately equal distances along the light strings, where said light strings are all electrically joined for connection to said power means, whereby the crown connector comprises a top ring for engaging the fastener, a circular split ring defining a gap through which the flagpole can pass, strands of varying lengths connecting the split ring and the top ring so that the split ring is generally horizontal when at the topmost position, and connection means for ends of the light strings on a circular frame.

2. The kit of claim 1 wherein the circular frame is adapted to be maintained generally horizontal position when the crown connector is in the topmost position.

3. The kit of claim 2 wherein a central connector engages the flagpole and radial arms extend from the central connector to connect it with the circular frame.

4. The kit of claim 3 wherein the central connector comprises two semi-circular bands defining a cylindrical center space for said flagpole and joined by removable fasteners so that the central connector is capable of being fixed to and removed from said flagpole at a lower portion of the flagpole.

5. The kit of claim 4 wherein the central connector comprises two or more concentric pairs of semi-circular bands and each adjacent pair of bands is connected by separating connectors, where removing one such set of separating connectors removes a pair of bands defining a cylindrical diameter smaller than another, greater cylindrical diameter for the adjacent pair of bands.

6. The kit of claim 5 wherein the central connector comprises two or more concentric pairs of semi-circular bands adjacent to each other, where removing one such set of separating connectors removes a pair of bands defining a cylindrical diameter smaller than another, greater cylindrical diameter for the adjacent pair of bands.

7. The kit of claim 5 wherein the circular frame comprises multiple arc sections connected by arc connection means at each connection between the arc sections so that a user can separate or fix together the arc sections.

8. The kit of claim 7 wherein the number of radial arms is equal the number of arc connection means and the radial arms connect with the circular frame at the arc connection means.

9. The kit of claim 8 wherein the arc connection means are adapted to be joined after the crown connector is raised to the topmost position.

10. A string light type imitation Christmas tree kit for installation on and support from a vertical flagpole by a user, where said kit comprises a circular crown connector adapted to secured at or near a top of said flagpole, multiple light strings are connected at one their ends to said crown connector and another of their ends is connected to an outer edge of a circular circular hoop means having a diameter two or more times that of the crown connector and fixed to a lower section of the flagpole, so that when said crown connector is fixed at the top of said flagpole said light strings extend outward radially from the flagpole and downward from the crown connector to the outer edge of the circular hoop means to generally define a conical structure which visually appears to be in the shape of a lighted Christmas tree when a power means provides electrical power to the light strings and the circular hoop means comprises a central connector comprising two or more sections capable of being joined to define a cylindrical center space, whereby said jointing about a lower section of the flagpole results in securing the circular hoop means to the flagpole and support arms connect the central connector with two or more joined arc sections forming the outer edge of the circular hoop means and said light strings are electrically removable from a common electrical connection about the outer edge and are further mechanically removable from connection to the crown connector and the outer edge for individual replacement.

11. The kit of claim 10 wherein the flagpole comprises a plurality of telescoping sections whereby a user may secure the crown connector to the top end of the flagpole when the flagpole sections are in a collapsed position.

12. The kit of claim 11 wherein said the crown connector comprises a round plate having a central opening, where the crown connector is removably secured to the top end of the flagpole by capital ornament means extending through the central opening to the top end of the flagpole and also supporting a capital ornament piece.

13. The kit of claim 12 wherein the capital ornament piece comprises lights which are connected to a common wiring harness for the light strings by way of a wire string extending from a connection at the crown connector to a connection at the outer edge of the circular hoop means.

* * * * *